US005224224A

United States Patent [19]

Hintz et al.

[11] Patent Number: 5,224,224

[45] Date of Patent: Jul. 6, 1993

[54] FOOT BATHING FIXTURE

[75] Inventors: Jonathan M. Hintz, Sheboygan Falls; Alan D. Bengtson, Sheboygan, both of Wis.

[73] Assignee: Kohler Co., Kohler, Wis.

[21] Appl. No.: 826,746

[22] Filed: Jan. 28, 1992

Related U.S. Application Data

[62] Division of Ser. No. 640,175, Jan. 11, 1991, abandoned.

[51] Int. Cl.[5] ..... A47K 3/022

[52] U.S. Cl. ..... 4/590; 4/541.1; 4/578.1; 4/621

[58] Field of Search ..... 4/541.1-541.6, 4/571.1, 573.1, 578.1, 579, 589, 590, 621, 622

[56] References Cited

U.S. PATENT DOCUMENTS

| | | | |
|---|---|---|---|
| D. 299,164 | 12/1988 | Burgess et al. | D23/283 |
| 2,336,127 | 12/1943 | Rocke . | |
| 2,508,969 | 5/1950 | Richardson . | |
| 2,589,281 | 3/1952 | Ocana . | |
| 2,589,592 | 3/1952 | Ocana | 4/590 X |
| 2,938,517 | 5/1960 | Friend | 128/66 |
| 3,027,568 | 4/1962 | Blau et al. . | |
| 3,096,526 | 7/1963 | Vecenie . | |
| 3,420,226 | 1/1969 | Berry | 128/24.1 |
| 4,339,833 | 7/1982 | Mandell | 4/542 |
| 4,432,103 | 2/1984 | Hunziker . | |
| 4,552,658 | 11/1985 | Adcock et al. | 210/169 |
| 4,853,987 | 8/1989 | Jaworski | 4/542 |

FOREIGN PATENT DOCUMENTS

| | | | |
|---|---|---|---|
| 0300577 | 7/1988 | European Pat. Off. . | |
| 1102729 | 2/1978 | Italy . | |
| 8502990 | 7/1985 | PCT Int'l Appl. | 4/578 |

OTHER PUBLICATIONS

An Itema ad for a shower cubicle, undated, admitted prior art.

A Kohler ad for the Whirlpool System II, undated, admitted prior art.

A Kohler ad for the #1190 seat, undated, admitted prior art.

A 1990 Jacob Delafon ad for the Neo Angle enclosure, admitted prior art.

An undated (admitted prior art) Jacob Delafon ad showing the Hydra shower tray.

*Primary Examiner*—Charles E. Phillips

*Attorney, Agent, or Firm*—Quarles & Brady

[57] ABSTRACT

A foot bathing fixture includes a seat supported on a raised pedestal. The pedestal has a hollow interior for housing a whirlpool pumping apparatus and other fixtures, for example a drain control. A removable access panel is located on the top of the pedestal to permit access to the pedestal interior for servicing the whirlpool pumping apparatus and other fixtures. The seat is positioned to cover the access panel when it is in position on top of the pedestal, and is hinged on the access panel so that the seat may be easily pivoted forward to access the pedestal for cleaning.

1 Claim, 5 Drawing Sheets

FOOT BATHING FIXTURE

This is a division of application Ser. No. 07/640,175, filed Jan. 11, 1991 and now abandoned.

BACKGROUND OF THE INVENTION

The field of the invention is moulded shower enclosures and more particularly, combined shower enclosures and drain pans which include a seat.

Shower enclosures are commonly moulded from acrylic or other suitable material as a one piece shell. The shell includes side walls and a bottom emptying into a drain, and in may cases also includes an integral seating surface moulded into a side wall or into a corner between two side walls.

It is also known in the prior art to provide a capability to close the drain and fill a bottom portion of the enclosure with water for the purpose of soaking a user's feet. For example, U.S. Pat. No. 2,589,281 shows a combined shower bath, foot bath and bidet, and U.S. Pat. No. 3,096,526 shows a foot bath insert for use in a shower.

Conventional whirlpool apparatus may be included with a foot bath configuration to implement a foot whirlpool. However, when a whirlpool apparatus is included, such apparatus must be made accessible for maintenance, adjustment and repair. The most common method utilized for providing access to the whirlpool mechanism is to cut an access opening through a wall adjacent to the shower enclosure into an adjacent closet, crawl space, or other unobtrusive area. In that way, access to the whirlpool mechanism is obtained from outside of the shower enclosure, thereby allowing the shower enclosure to remain a one piece, sealed shell. Depending upon a particular room layout, however, such access may not be possible, for example, if the walls adjacent to the shower enclosure are exterior walls, or more commonly, if the presence of the access opening in the area on the opposite side of the adjacent wall would be aesthetically objectionable.

Other types of combination foot whirlpool/shower enclosures are known in which an outside wall of the enclosure, is open to the room containing the shower enclosure, with the outside wall being fitted with a removable panel for access to the whirlpool apparatus. This arrangement also enables the interior shell for the shower to be a one piece, sealed enclosure. However, it does impose limitations on the placement of the enclosure, e.g. that the removable panel be open to the room interior and be large enough to provide easy access. The above limitations require that a fairly large area, i.e. the whirlpool apparatus and removable panel, be placed adjacent the room interior, where it detracts from the the available area for entrance to the shower enclosure and otherwise limits design possibilities with respect to the esthetic appearance of the shower enclosure. For example, this arrangement would not be feasible in a three walled, alcove installation where only a front wall is available for shower entrance (e.g. the removable panel would present a sizable obstruction to that entrance).

SUMMARY OF THE INVENTION

In one aspect, the invention provides a foot bathing fixture with a foot bath having a bottom with a drain and generally vertical side walls. A user seating arrangement permits the user to sit while feet are being bathed. There is a seating arrangement including a seating pedestal with a seat at the top which is located above the bottom of the bath. A channel is provided for conveying water away from the seat into the foot bath.

In another preferred form, the seating arrangement includes a seating pedestal with a hollow interior. A whirlpool pumping apparatus is located in the hollow interior of the pedestal. The seat can be moved to obtain access to the whirlpool pumping apparatus in the hollow interior of the pedestal.

In still another preferred form, there is a seat arrangement for a plumbing fixture having adjoining approximately orthogonal walls defining a corner. A seat pedestal includes a generally horizontal top wall and generally vertical corner walls connected to the top wall. The corner walls are inwardly spaced from the fixture walls and continuously connected thereto below the top wall to define a drain conduit for water flowing down the fixture walls.

The objects of the invention therefore include:

a. providing a foot bathing fixture of the above kind wherein a seating arrangement includes a seating pedestal with a seat at the top and a channel for conveying water away from the seat and into the bath.

b. providing a foot bathing fixture of the above kind which is adapted to fit between orthogonal walls with a seat pedestal and provide proper water drainage.

c. providing a foot bathing fixture of the above kind wherein a whirlpool pumping apparatus is located in the hollow interior of the pedestal and is accessible by moving the seat.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
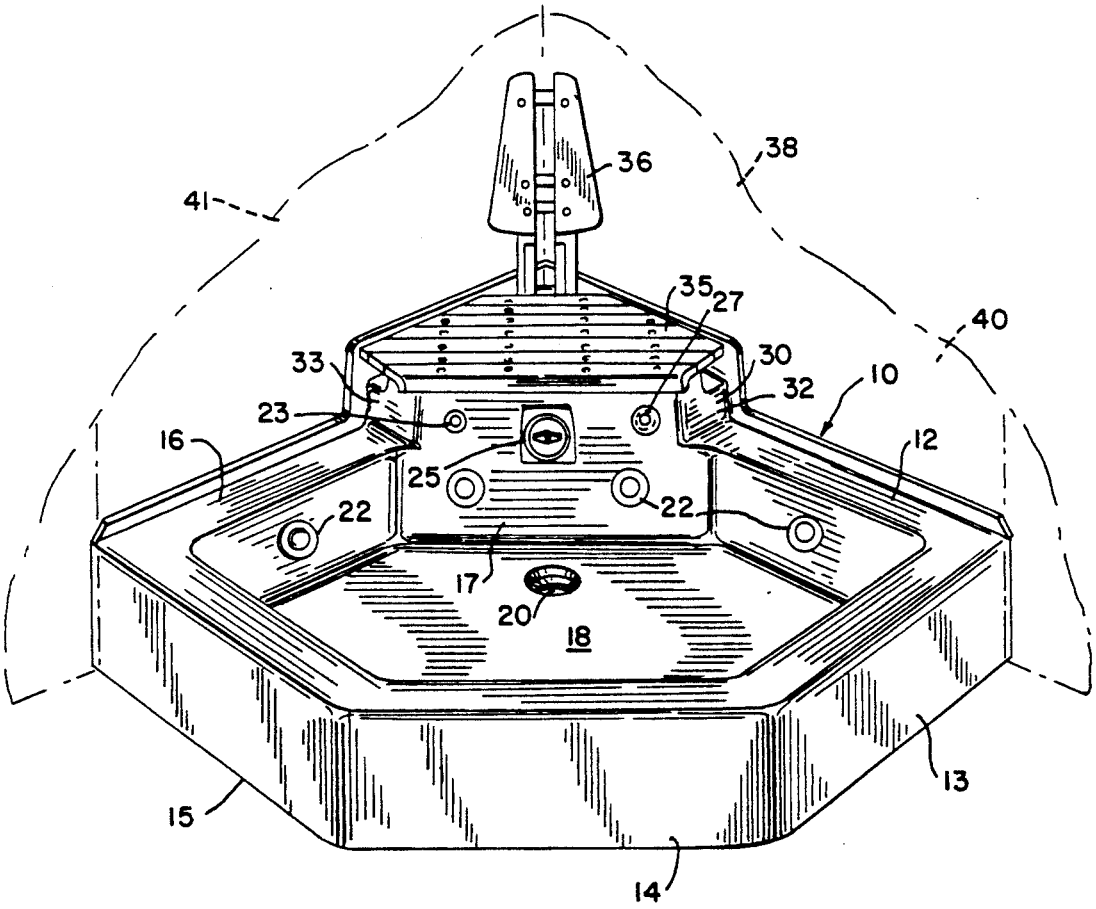
FIG. 1 is a top front perspective view showing the foot bathing fixture constituting a preferred embodiment of the invention.
Figure 2:
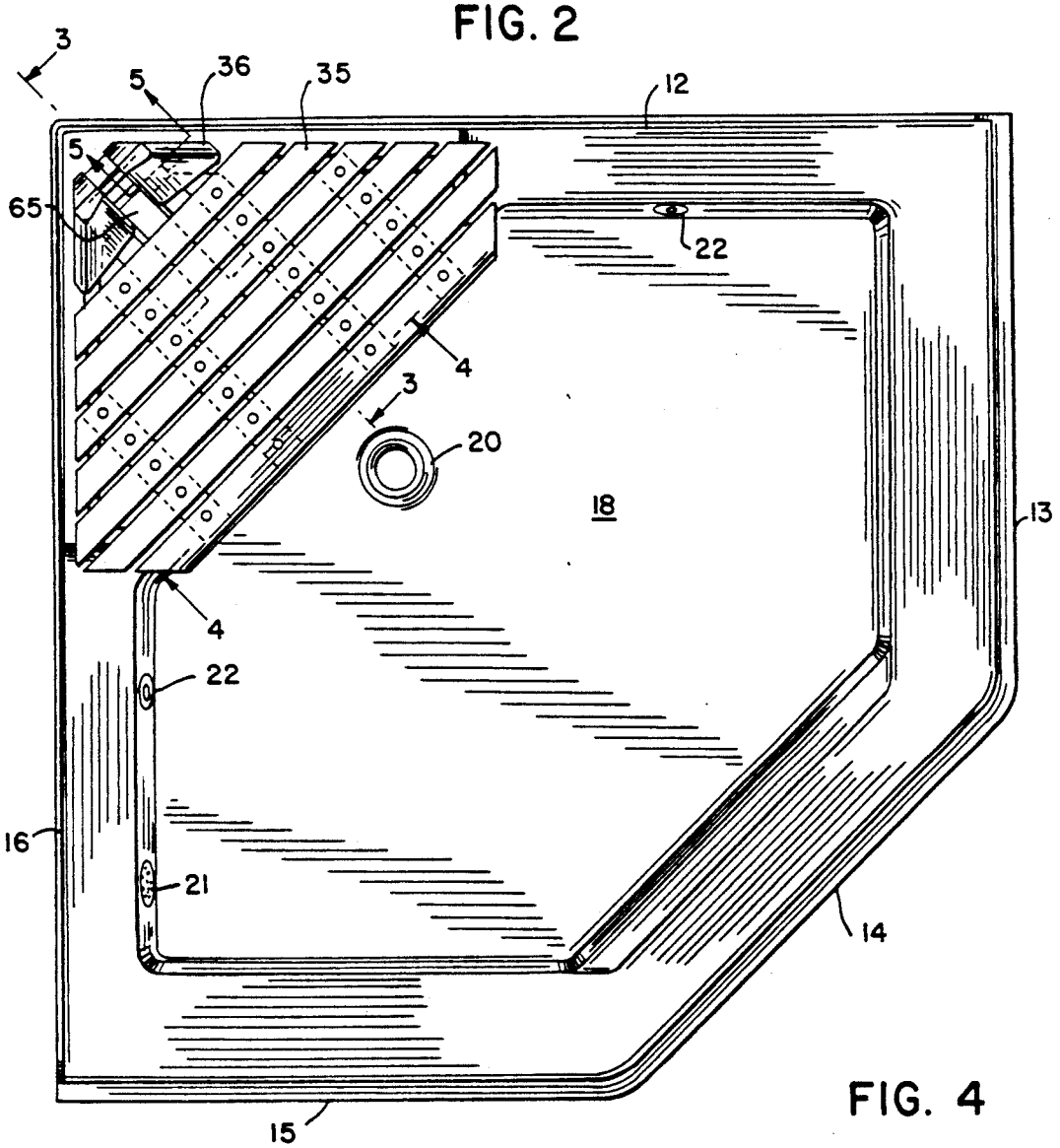
FIG. 2 is a top plan view of the bathing fixture shown in FIG. 1.

Referring to FIGS. 1 and 2, the bathing fixture generally 10 has the side walls 11, 12, 13, 14, 15, 16 and 17 to provide with the bottom wall 18 a foot bath. This is formed in a one piece molded plastic construction. There is the usual drain 20 in the bottom wall and the whirlpool jet outlets 22 in the walls 12, 16 and 17. A water inlet 21 is placed in wall 16 and wall 17 has a start/stop bottom 23, an overflow drain 25, as well as an air inlet 27.

A seat pedestal portion 30 includes side wall 17 and extends above the surrounding side walls 12 and 16. It includes the raised wall portions 32 and 33. Seat pedestal 30 provides a raised support for the seat 35 and the back rest 36 which in this instance is formed from teakwood.

Referring specifically to FIG. 1, it is seen that the bathing fixture 10 is utilized in conjunction with a shower attachment 38. This is illustrated by the enclosure walls 40 and 41.

Figure 4:
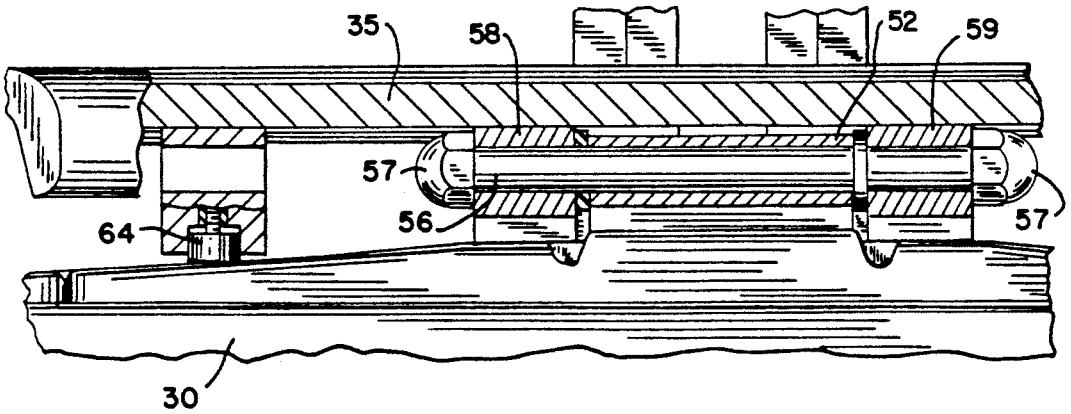
FIG. 4 is a sectional view taken along line 4—4 of FIG. 2.
Figure 3:
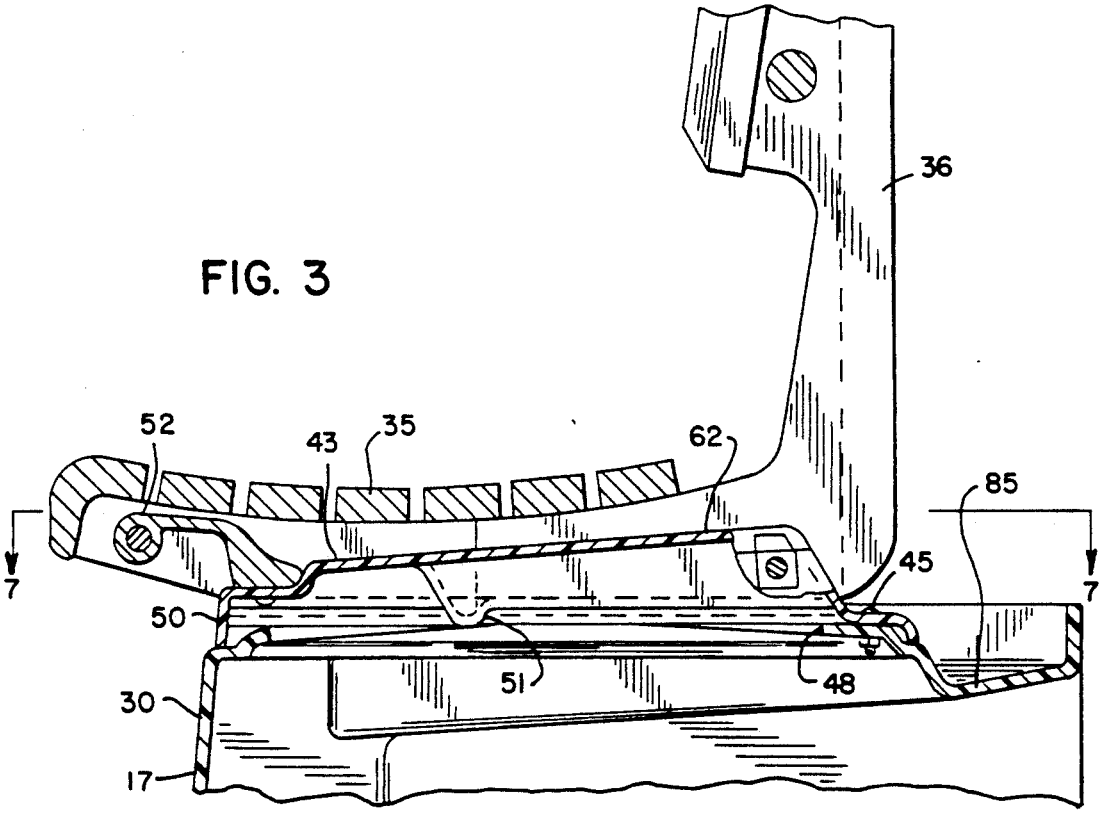
FIG. 3 is a sectional view taken along line 3—3 of FIG. 2.

As best seen in FIGS. 3, 4, 6 and 7, the seat 35 is hingedly attached over to the seat pedestal 30. This is provided by the raised support member 43 which is formed as part of the cover 60 (See FIG. 7). It is secured to the seat pedestal 30 such as by the nut and bolt fasteners 45. Note that the attachment is made adjacent the access opening 48 to the hollow seat pedestal 30. Support member 43 has flange portions 50 and 51 for spacing the support member 43 above the seat pedestal 30 and the cover 60. As best seen in FIGS. 3 and 4, a hinge portion 52 is secured to support member 43. The seat 35 is pivotally attached to the hinge portion 52 by the hinge pin 56 which passes through the hinge portion 52 and the hinge portions 58 and 59 of the seat 35. Hinge pin 56 is secured by the nuts 57. An adjustable foot member 64 provides support of the seat 35 on the pedestal 30.

Figure 7:
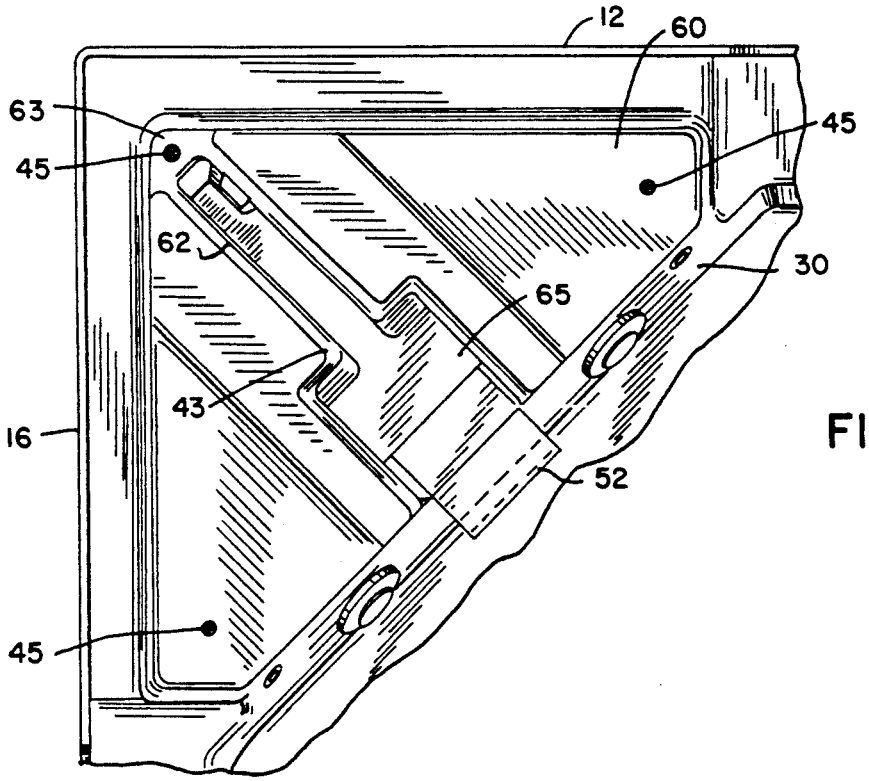
FIG. 7 is a sectional view taken along line 7—7 of FIG. 3.

Referring specifically to FIG. 7, it is seen that the top of the hollow pedestal 30 is closed by the cover 60 which is secured to the pedestal 30 by the nuts and bolts 45. The seat support member 43 rises above the cover 60 in a substantially T-shaped configuration with the tongue portion 62 extending toward the corner 63 of the walls 12 and 16. The enlarged head 65 affords connection with the hinge portion 52.

Figure 5:
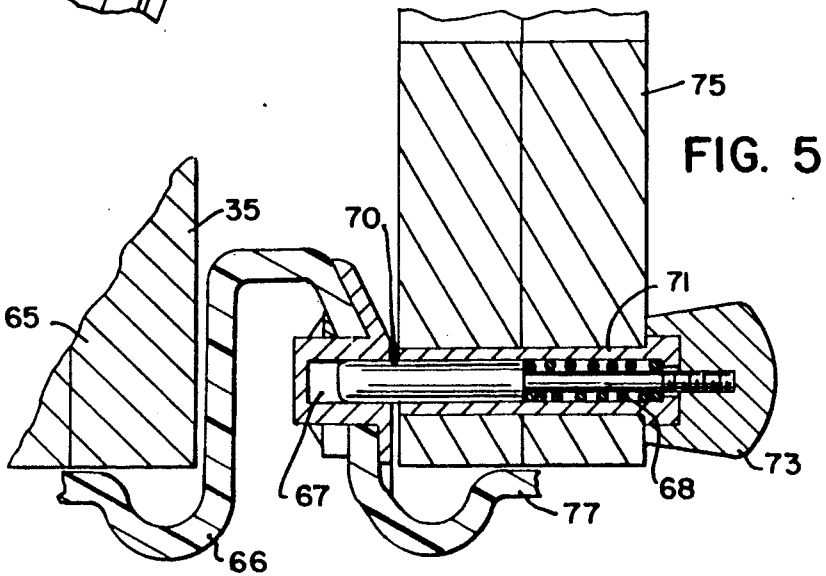
FIG. 5 is a sectional view taken along line 5—5 of FIG. 2.

FIG. 5 illustrates the latching of the seat 35 to the top of the pedestal 30 when the seat is in a lowered position. Seat 35 has an extending base member 65 to which is secured U-shaped latch member 66 having pin receiving channel 67. A latch pin 70 is biased by the spring 68 in guide member 71 and is actuated by knob 73. The guide member 71, and accordingly the latch pin 70, are supported in the base member 75 suitably connected to the support member 43. A secure latching is provided by the hooked end 77 contacting the base member 75 when the latch pin 70 engages the channel 67.

Figure 8:
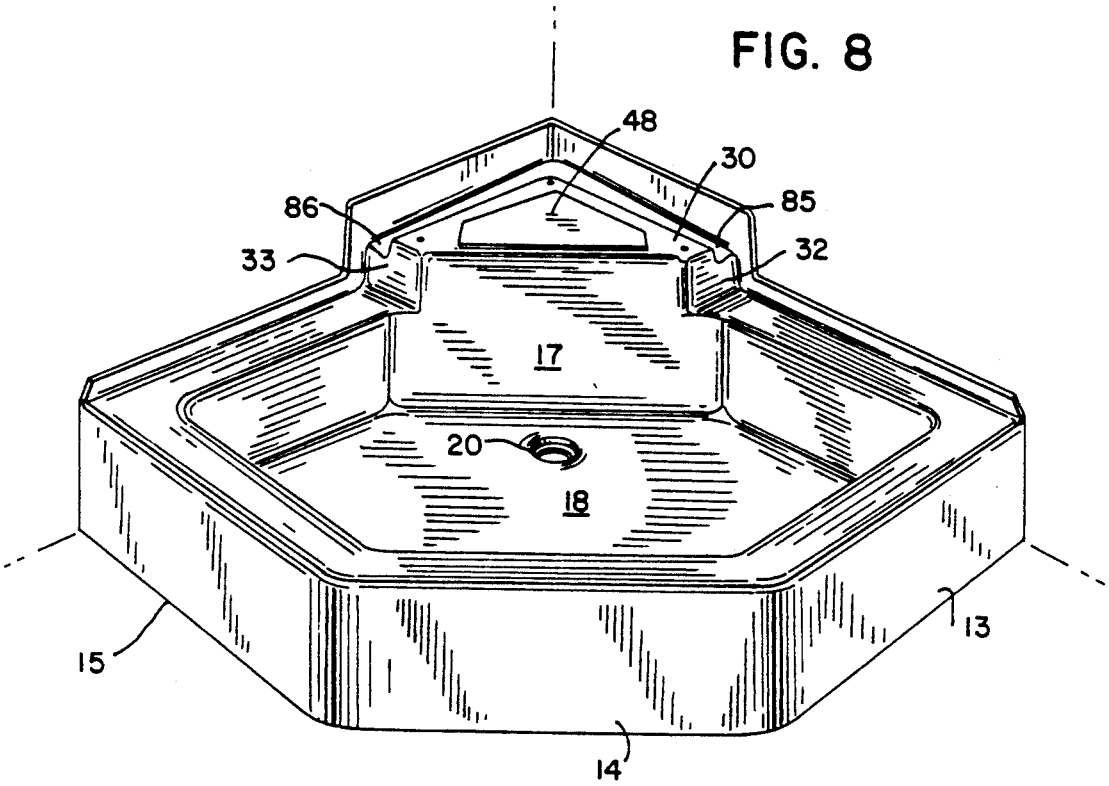
FIG. 8 is a view similar to FIG. 1 with the seat removed and showing the access opening in the pedestal.
Figure 8A:
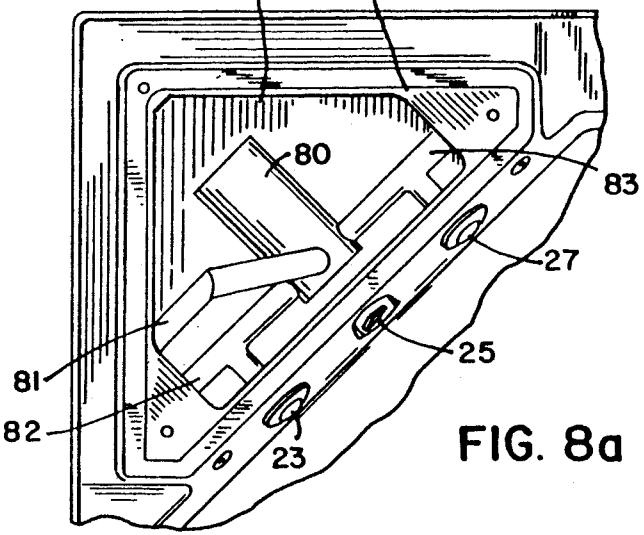
FIG. 8*a* is a view similar to FIG. 7 with the access panel removed and showing the pumping apparatus in the pedestal.

FIGS. 8 and 8*a* illustrate the access into the hollow seat pedestal 30. The cover 60 has been removed which exposes the access opening 48. As best seen in FIG. 8*a*, the hollow pedestal 30 houses the usual pump 80 to which are connected the water intake conduit 81, the outlet conduit 82 and the air intake conduit 83. It also houses the pumping for the overflow 25 as well as the electrical connections for the start bottom 23.

Figure 6:
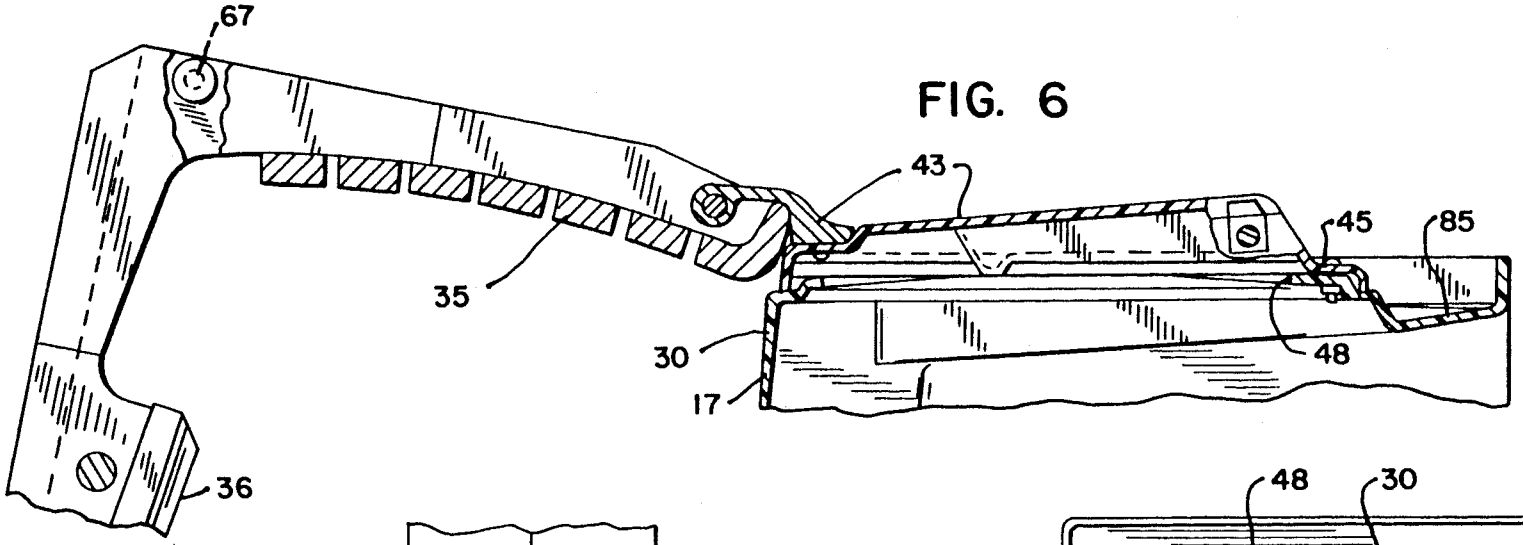
FIG. 6 is a view similar to FIG. 3 showing the seat in a forward position.

FIGS. 3, 6 and 8 best illustrate the channels 85 and 86 formed as a part of the walls 32 and 33 and which surround the seat pedestal 30. These serve to carry water away from the seat and into the foot bath when the bathing fixture 10 includes a shower enclosure attachment as represented by the walls 40 and 41 in FIG. 1.

Figure 9:
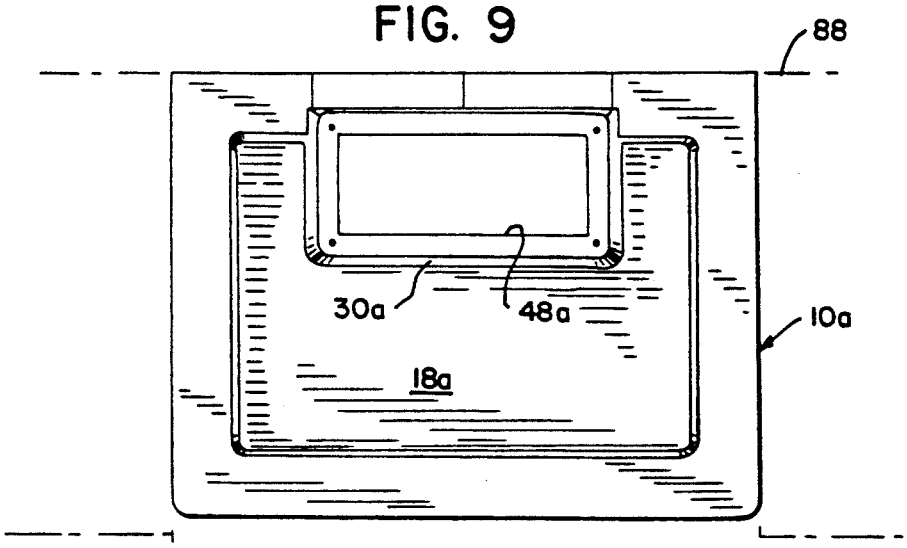
FIG. 9 is a top plan view of an alternative embodiment.

FIG. 9 illustrates an alternative embodiment generally 10*a* which is designed for use in conjunction with a single wall 88 and not at a corner. Similar components are designated by the same numbers except followed by the letter "a". It has the raised seat pedestal 30*a* and the access opening 48*a* which affords access to the housed pump and other plumbing apparatus as previously described in conjunction with FIG. 8*a*.

One of the important features of this invention is that the seat pedestal 30 has a seat 35 at the top which is located above the bottom of the bath, and there is provided means for conveying water away from the seat and into the foot bath. This is afforded by the channels 85 and 86.

An additional feature is the fact that the seat pedestal is hollow and the seat can be moved to obtain access to the interior of the pedestal. The pedestal will house the usual pump and other plumbing apparatus.

Yet another important feature is the fact that the pedestal with the water conveying channel and the accessible housing for the pumping apparatus can be utilized in various geometric configurations such as with orthogonal walls defining a corner for fitting into corner walls or can be designed for attachment against a single wall.

Thus the invention provides an improved foot bathing fixture. While preferred embodiments have been described above, it should be readily apparent to those skilled in the art from this disclosure that a number of modifications and changes may be made without departing from the spirit and scope of the invention. For example, while a particular seat and backrest has been shown, the raised seat pedestal can be used with seats of various types as well as various types of attachments. Also, the specific materials mentioned are not the only materials which can be used. All such and other modifications within the spirit of the invention are meant to be within the scope of the invention.

We claim:

1. A foot bathing fixture comprising a foot bath having a bottom with a drain and generally vertical side walls; a user seating arrangement that permits the user to sit while feet are being bathed, said seating arrangement comprising a seating pedestal with a hollow interior and a seat at the top which is located above the bottom of the bath; and whirlpool pumping apparatus located in the hollow interior of the pedestal; wherein the seat can be moved to obtain access to the whirlpool pumping apparatus in the hollow interior of the pedestal; the seat being attached to an access panel, and the access panel is removably attached to the top of the pedestal to cover an access opening in the top of the pedestal and the seat is pivotally attached to the access panel to permit the seat to be pivoted to provide access to the top of the pedestal with the access panel in place.

* * * * *